US005185556A

United States Patent [19]

Yagi et al.

[11] Patent Number: 5,185,556

[45] Date of Patent: Feb. 9, 1993

[54] GAS-FILLED DISCHARGE TUBE

[75] Inventors: Kiyoshi Yagi; Seiichi Wakabayashi, both of Gotenba, Japan

[73] Assignee: Yazaki Corporation, Tokyo, Japan

[21] Appl. No.: 542,223

[22] Filed: Jun. 22, 1990

[30] Foreign Application Priority Data

Jul. 19, 1989 [JP] Japan ..... 1-184516

[51] Int. Cl.[5] ..... H01J 17/20

[52] U.S. Cl. ..... 313/637; 313/620; 313/631

[58] Field of Search ..... 313/570, 620, 637, 643, 313/621, 631, 634; 361/120, 129, 130

[56] References Cited

U.S. PATENT DOCUMENTS

| | | | |
|---|---|---|---|
| 2,215,300 | 9/1940 | Ryde | 176/122 |
| 2,457,102 | 12/1948 | Jones | 315/56 |
| 2,682,007 | 6/1954 | Hilder | 313/40 |
| 3,119,040 | 1/1964 | Gardiner et al. | 313/214 |
| 3,742,280 | 6/1973 | Siegle | 313/118 |
| 3,956,657 | 5/1976 | Siegle | 313/214 |
| 3,995,183 | 11/1976 | Lechner et al. | 313/124 |

FOREIGN PATENT DOCUMENTS 2083692A 3/1982 United Kingdom .

*Primary Examiner*—Michael T. Razavi
*Assistant Examiner*—Steven P. Klocinski
*Attorney, Agent, or Firm*—Nikaido, Marmelstein, Murray & Oram

[57] ABSTRACT

A gas-filled discharge tube for voltage control particularly for the series gap of the ignition system of an automotive spark-ignition engine. The gas-filled discharge tube is capable of operating stably at a sufficiently high discharge inception voltage, requires a sufficiently low discharge sustaining voltage and is capable of accurately controlling the ignition timing of the automotive spark-ignition engine regardless of the variation of the output voltage of the ignition coil of the ignition system. The gas-filled discharge tube is provided with discharge electrodes meeting requirements that the opposite surfaces of the discharge electrodes are substantially flat, the discharge electrodes have no sharp edge, and the product of the diameter of the discharge electrodes and the distance between the discharge electrode is 20 $mm^2$ or below. The gas-filled discharge tube is filled with a mixed gas having a composition of 50% by volume or below in nitrogen content and 50% or above in argon content.

2 Claims, 2 Drawing Sheets

GAS-FILLED DISCHARGE TUBE

BACKGROUND OF THE INVENTION

1. Field of the Invention

The present invention relates to a discharge tube for voltage control and, more specifically, to a gas-filled discharge tube for operation as the series gap of the ignition system of an automotive spark-ignition engine.

2. Description of the Prior Art

The ignition system of an automotive spark-ignition engine applies a high voltage across the electrodes of a spark plug to pass an electrical discharge between the electrodes. A previously proposed, ignition system of a series gap type employs a discharge gap connected in series to a spark plug to control the ignition timing accurately and prevent the smoking of the explosive mixture. Such an ignition system of a series gap type employs a gas-filled discharge tube comprising a tube filled with an inert gas, and electrodes provided respectively at the opposite ends of the tube. The accurate control of the spark timing by using the gas-filled discharge tube serving as a series gap requires a discharge inception voltage of the discharge tube higher than that of the spark plug, for example, the former not lower than 10 KV. The discharge inception voltage of the tube can be increased by increasing the distance between the electrodes or by increasing the pressure of the inert gas filling the tube. However, such a measure for increasing the discharge inception voltage entails unstable discharge inception voltage and requires a comparatively high discharge sustaining voltage, which increases energy loss and affects adversely to the reliability of the igniting function of the spark plug.

SUMMARY OF THE INVENTION

Accordingly, it is an object of the present invention to provide a gas-filled discharge tube for the ignition system of an automotive spark-ignition engine, capable of operating stably at a sufficiently high discharge inception voltage, requiring a comparatively low discharge sustaining voltage, and capable of accurately controlling the ignition timing regardless of fluctuations in the ignition coil output voltage of the ignition system according to the operating condition of the automotive spark-ignition engine.

In one aspect of the present invention, a gas-filled discharge tube comprises an electrically insulating tube filled with a pressurized gas, and a pair of electrodes provided opposite to each other within the electrically insulating tube. The opposite surfaces of the discharge electrodes are formed substantially in a flat surface, the electrodes have no sharp edge, and the gas filling the electrically insulating tube is argon gas, nitrogen gas or a mixed gas of argon gas and nitrogen gas.

The substantially flat opposite surfaces of the discharge electrodes of the gas-filled discharge tube prevents local discharges. Since the electrodes have no sharp edges and the electrically insulating tube is filled with an inert gas, such as argon, nitrogen or a mixed gas of argon and nitrogen, the surfaces of the electrodes are less susceptible to deterioration and a stable discharge can be sustained.

Furthermore, the pressure of the gas not lower than 5 atm and the product of the diameter of the electrodes and the distance between the electrodes not greater than 20 $mm^2$ stabilize the discharge inception voltage still further. A mixed gas containing 50% by volume or less nitrogen and 50% or more argon by volume reduces the discharge sustaining voltage to a comparatively low level without decreasing the discharge inception voltage.

BRIEF DESCRIPTION OF THE DRAWINGS

The above and other objects, features and advantages of the present invention will become more apparent from the following description taken in connection with the accompanying drawings, in which.

DETAILED DESCRIPTION OF THE PREFERRED EMBODIMENT

Figure 1:
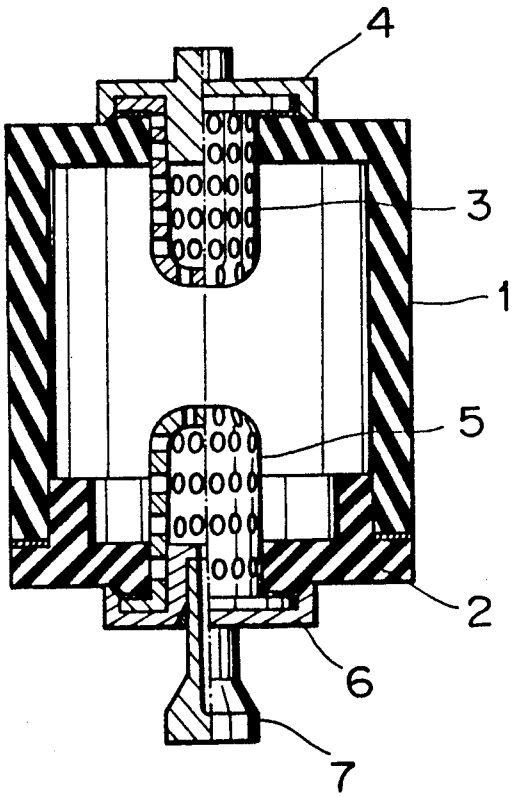
FIG. 1 is a longitudinal sectional view of a gas-filled discharge tube in a preferred embodiment according to the present invention.

Referring to FIG. 1, a gas-filled discharge tube in a preferred embodiment according to the present invention comprises a tube 1 formed of an electrically insulating material such as a ceramic, an end cap 2 formed of the same material as that forming the tube 1, a first discharge electrode 3 having a longitudinal section resembling the shape of the letter U, having a substantially flat top surface, formed of a perforated metallic plate and inserted in the tube 1 through an opening formed in the top wall of the tube 1, a first terminal 4 connected to the first discharge electrode 3, a second discharge electrode 5 of the substantially same construction as that of the first discharge electrode 3 and inserted in the tube 1 through an opening formed in the end cap 2, a second terminal 6 connected to the second discharge electrode 5, and a gas-charging pipe 7 combined with the second terminal 6. The first discharge electrode 3 is fixed together with the first electrode 4 to the top wall of the tube 1 with glass or a metallic solder so as to seal the gap between the first electrode 3 and the opening of the top wall of the tube 1, and the second discharge electrode 5 is fixed to the end cap 2 with glass or a metallic solder so as to seal the gap between the second discharge electrode 5 and the opening of the end cap 2. The gas-charging pipe 7 is sealed by crushing and soldering after charging the assembly of the tube 1, the cap 2 and the electrodes 3 and 5 with a pressurized gas.

The gas-filled discharge tube thus constructed employs argon gas, nitrogen gas or a mixed gas of argon gas and nitrogen gas for filling the tube 1 and is capable of stably and satisfactorily operating for a long duration of service at a high discharge inception voltage of 10 KV or higher.

Incidentally, when nitrogen gas of high purity is used for filling the tube of the gas-filled discharge tube, the discharge inception voltage can readily be increased up to such a high voltage, for example, 15 KV, by increasing the gas pressure as proposed previously. When an inert gas, such as argon or helium is used for filling the tube of the gas-filled discharge tube, the pressure of the inert gas must be very high to make the gas-filled discharge tube operate at a sufficiently high discharge inception voltage. However, the increased voltage by increasing the pressure of the inert gas filling the tube of the gas-filled discharge tube is liable to fluctuate unavoidably in a certain range under some operating condition. The fluctuation in the voltage can effectively suppressed when the pressure of the gas filling the tube, such as argon, nitrogen or a mixed gas of argon and nitrogen, is 5 atm or higher and the product of the diameter of the discharge electrodes and the distance between the discharge electrodes is 20 $mm^2$ or less. A pressure of the gas lower than 5 atm makes discharging position on the opposite surfaces of the discharge electrodes unsteady, makes discharges liable to pass between the side surfaces of the discharge electrodes and is unable to suppress the fluctuation in the discharge inception voltage. The reduction of the product of the diameter of the discharge electrodes and the distance between the discharge electrodes reduces the fluctuation in the discharge inception voltage very effectively.

Figure 2:
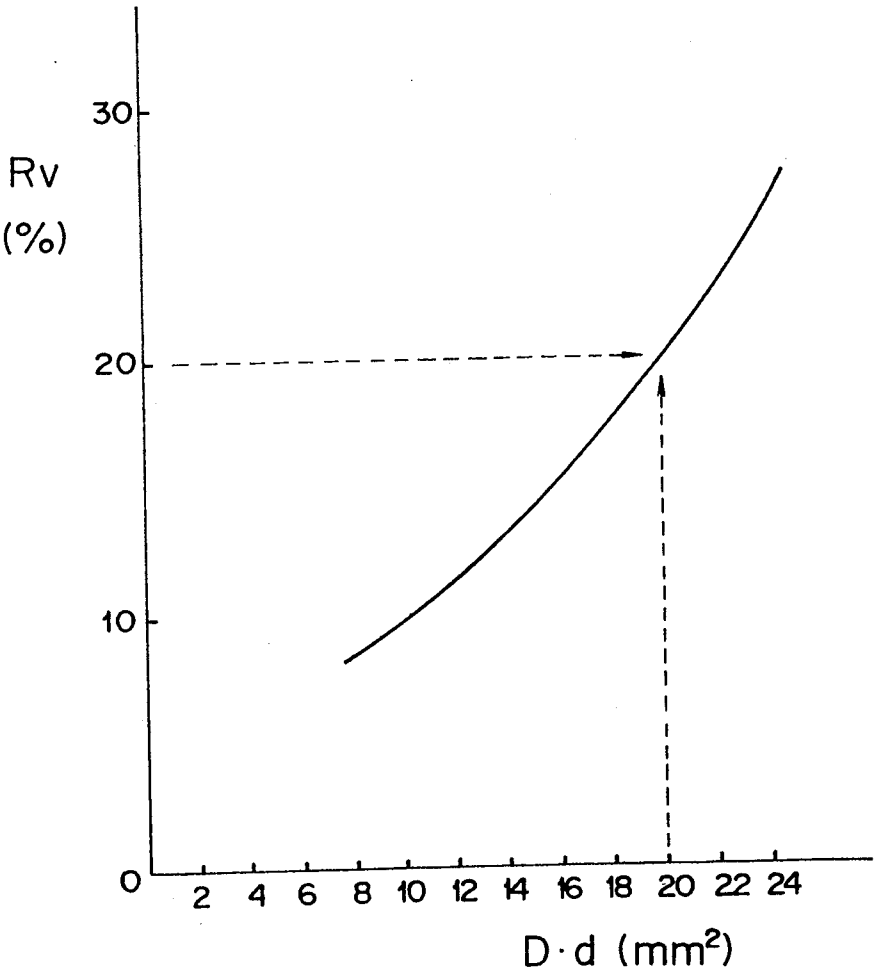
FIG. 2 is a graph showing the relationship between the magnitude of variation of the discharge inception voltage of the gas-filled discharge tube of FIG. 1 and the product D.d, where D is the diameter of the electrodes of the gas-filled discharge tube and d is the distance between the electrodes.

Test gas-filled discharge tubes of the construction shown in FIG. 1 respectively having pairs of discharge electrodes differing from each other in the diameter D (mm) of the discharge electrodes and the distance d (mm) between the discharge electrodes and filled respectively with mixed argon-nitrogen gases of different compositions so that the discharge inception voltage is 15 KV were fabricated. The test gas-filled discharge tubes were subjected to repetitive discharge tests to determine the range $R_v$(%) of variation of the discharge inception voltage. Test results are shown in FIG. 2. As is obvious from FIG. 2, the product D.d of the diameter D of the discharge electrodes and the distance d between the discharge electrodes must be 20 $mm^2$ or less to restrict the discharge inception voltage to a range of $15 \pm 1.5$ KV, namely, to restrict the range of variation of the voltage to 20% or below. In the discharge tubes, the increased discharge inception voltage causes unfavorably high discharge sustaining voltage. It is to be desired that this discharge sustaining voltage should be maintained as low as possible, with high discharge inception voltage, for example, 15 kV.

Figure 3:
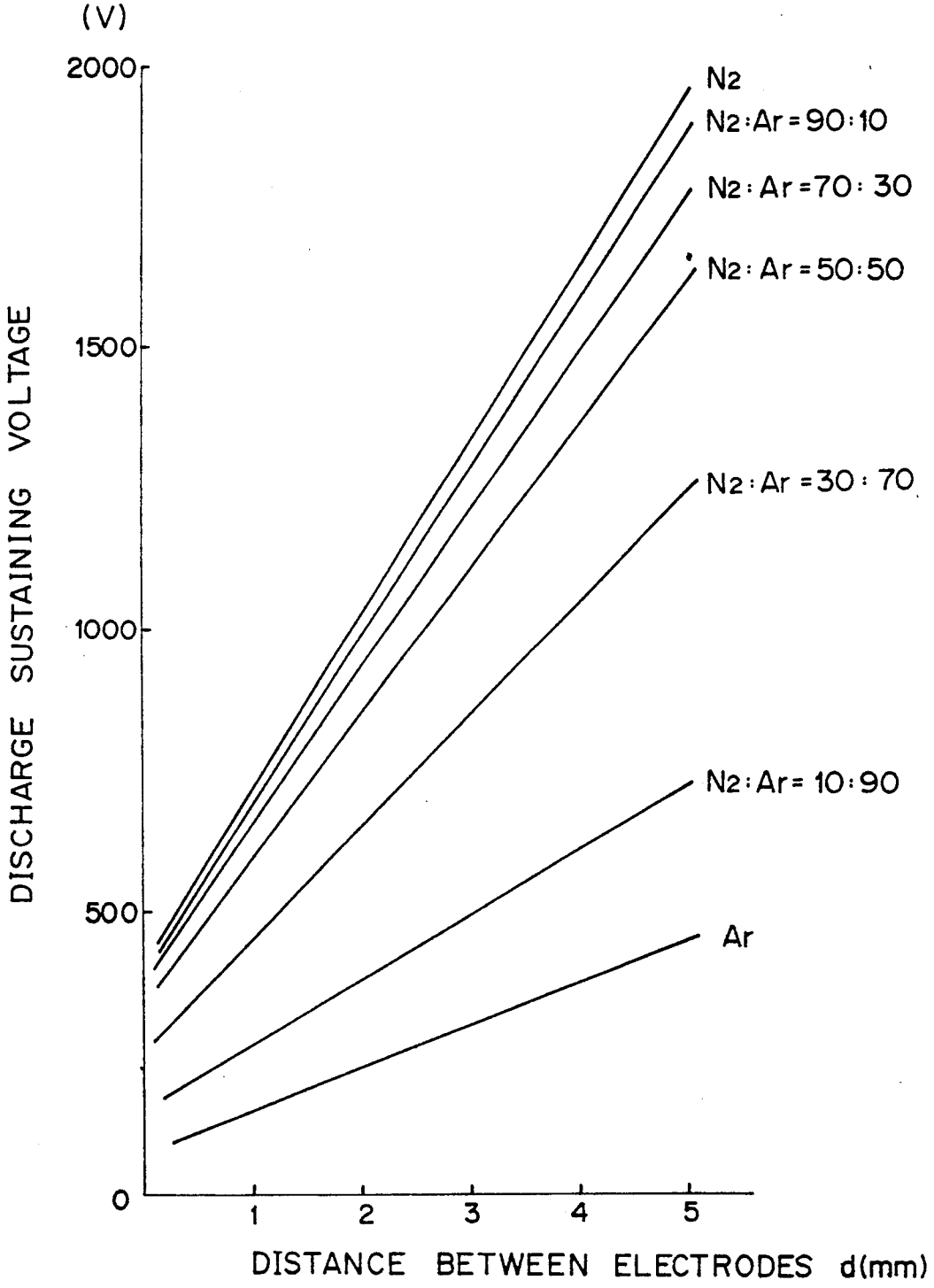
FIG. 3 is a graph showing the variation of discharge sustaining voltage with the distance between the electrodes of the gas-filled discharge tube of FIG. 1 for different compositions of the argon-nitrogen mixed gas filling the gas-filled discharge tube of FIG. 1.

Test gas-filled discharge tubes of the construction shown in FIG 1 respectively having pairs of discharge electrodes differing from each other in the distance d (mm) between the discharge electrodes and filled respectively with gases of different compositions so that the discharge inception voltage is 15 KV were fabricated. These test gas-filled discharge tubes were tested for the discharge sustaining voltages. Test results are shown in FIG. 3. As is obvious from FIG. 3, the discharge sustaining voltage v varies linearly with the distance d (mm) between the discharge electrodes, the discharge sustaining voltage varies in a comparatively narrow range when the nitrogen content of the gas is higher than 50% by volume, and the discharge sustaining voltage drops sharply when the nitrogen content of the gas is 50% by volume or below and the argon content of the same is 50% by volume or above.

Thus, a pressure of 5 atm or above of the gas filling the gas-filled discharge tube and the product of the diameter of the discharge electrodes and the distance between the discharge electrodes of 20 $mm^2$ or less are preferable to reduce the range of variation of the discharge inception voltage, maintaining the voltage at a high level. A composition of the gas filling the gas-filled discharge tube of 50% by volume or below nitrogen content and 50% by volume or above argon content is preferable to reduce the discharge sustaining voltage maintaining the discharge inception voltage at a high level.

Although the invention has been described in its preferred form with a certain degree of particularity, obviously many changes and variations are possible therein. It is therefore to be understood that the present invention may be practiced otherwise than as specifically described herein without departing from the scope and spirit thereof.

What is claimed is:

1. A gas-filled discharge tube comprising:

a tube formed of an electrically insulating material and filled with a pressurized gas; and a pair of opposite discharge electrodes provided at opposite end of the tube, wherein the discharge electrodes respectively have opposite, substantially flat surfaces, and are formed in a shape having no sharp edges, and wherein the gas which fills the tube is a mixed gas having a nitrogen content of no more than 50% by volume and an argon content of at least 50% by volume.

2. A gas-filled discharge tube as claimed in claim 1, wherein the product of the diameter of the discharge electrodes and the distance between the discharge electrodes is no more than 20 $mm^2$, and a pressure of the gas filling the tube is at least 5 atm.

* * * * *